US007233756B2

(12) United States Patent
Tamura

(10) Patent No.: US 7,233,756 B2
(45) Date of Patent: Jun. 19, 2007

(54) IMAGE FORMING APPARATUS INCLUDING GRAVITY-OPERATED OPENING AND CLOSING MEMBER FOR DISCHARGING EXCESS DEVELOPER

(75) Inventor: Masashige Tamura, Chiba (JP)

(73) Assignee: Canon Kabushiki Kaiska, Tokyo (JP)

( * ) Notice: Subject to any disclaimer, the term of this patent is extended or adjusted under 35 U.S.C. 154(b) by 53 days.

(21) Appl. No.: 10/693,981

(22) Filed: Oct. 28, 2003

(65) Prior Publication Data

US 2004/0086301 A1 May 6, 2004

(30) Foreign Application Priority Data

Oct. 31, 2002 (JP) ..... 2002-318867

(51) Int. Cl.
*G03G 15/01* (2006.01)
*G03G 15/08* (2006.01)

(52) U.S. Cl. ..... 399/227; 399/258

(58) Field of Classification Search ..... 399/119, 399/120, 227, 258, 262, 264
See application file for complete search history.

(56) References Cited

U.S. PATENT DOCUMENTS 5,508,794 A 4/1996 Ikesue et al. ..... 399/120
5,752,141 A 5/1998 Nishimura et al. ..... 399/227

FOREIGN PATENT DOCUMENTS

| | | | |
|---|---|---|---|
| JP | 06019300 A | * | 1/1994 |
| JP | 6-308829 | | 4/1994 |
| JP | 9-218575 | | 8/1997 |
| JP | 10-142888 | | 5/1998 |
| JP | 2000066500 A | * | 3/2000 |
| JP | 2002258611 A | * | 9/2002 |

* cited by examiner

*Primary Examiner*—David M. Gray
*Assistant Examiner*—Ryan Gleitz
(74) *Attorney, Agent, or Firm*—Fitzpatrick, Cella, Harper & Scinto

(57) ABSTRACT

An image forming apparatus has a developing device containing therein a developer including a toner and a carrier, the developing device having a first chamber for developing an electrostatic image formed on an image bearing member, and a second chamber constituting a developer circulating route between it and the first chamber, a carrying member rotatably provided in the second chamber for carrying the developer, a rotary member holding the developing device and rotatable in a route including a developing position, a supplying device for supplying the developer to the developing device when at the developing position, an opening provided in the second chamber for outwardly discharging therethrough any excess developer resulting from the supply of the developer, and a wall portion provided in the second chamber for suppressing the developer flowing out through the opening with the rotation of the rotary member.

6 Claims, 11 Drawing Sheets

FIG. 7B
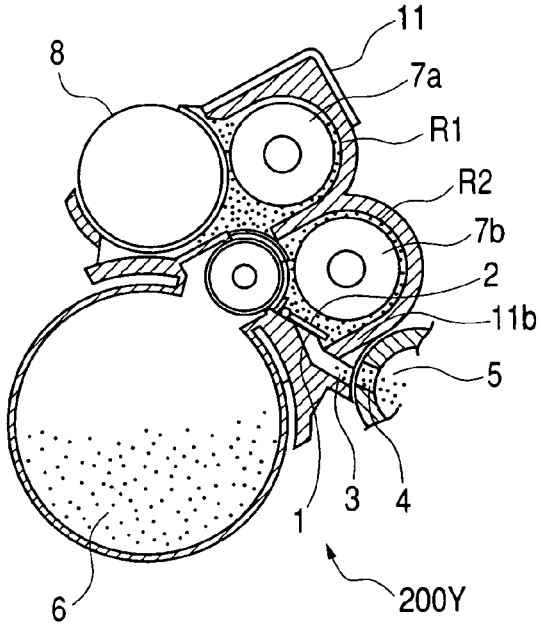
FIG. 7A
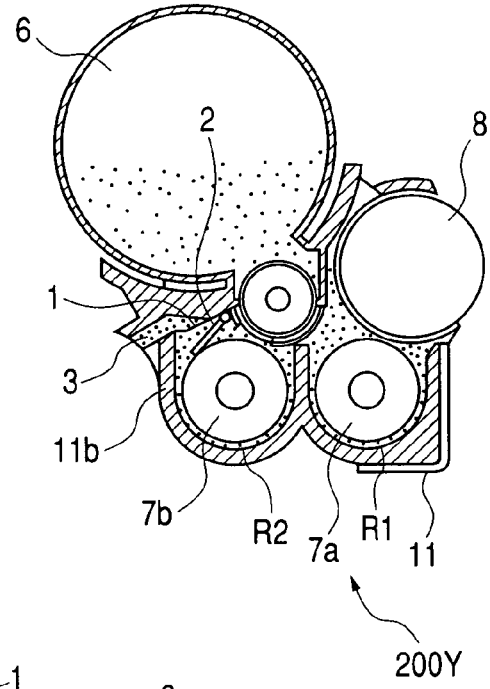
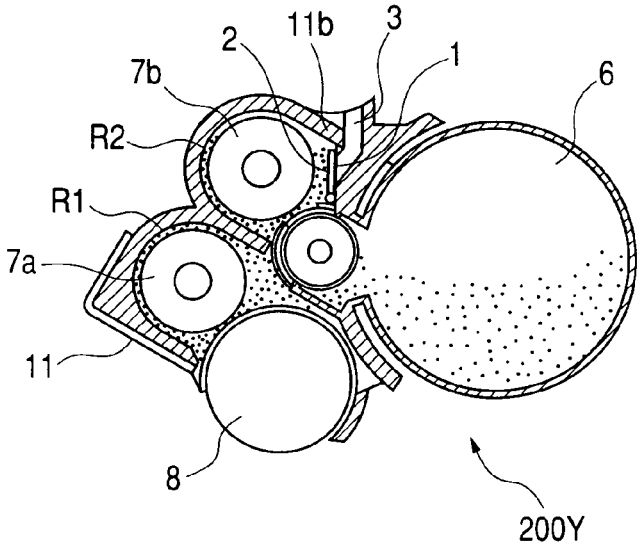
FIG. 7C

IMAGE FORMING APPARATUS INCLUDING GRAVITY-OPERATED OPENING AND CLOSING MEMBER FOR DISCHARGING EXCESS DEVELOPER

BACKGROUND OF THE INVENTION

1. Field of the Invention

The invention relates to an image forming apparatus using an electrophotographic process or an electrostatic recording process, and particularly to an image forming apparatus such as a copying machine, a printer or a facsimile apparatus.

2. Description of Related Art

Generally in multi-color image forming, use is made of the technique of developing an electrostatic latent image formed by external information with developers of plural colors, successively forming developer images toner images of the plural colors on a photosensitive member which is an image bearing member, and successively or collectively superimposing these toner images of the plural colors on a transferring medium such as paper.

In such a multi-color image forming apparatus, there is, for example, a rotary type developing apparatus having developing apparatuses for plural colors, e.g. black, yellow, magenta and cyan mounted in a rotary member (rotary type developing body) along the rotational circumference thereof, and a so-called rotary developing process of rotating the rotary type developing body to thereby successively move necessary developing apparatuses to a developing position opposed to the photosensitive member which is an image bearing member and perform a developing operation has heretofore been proposed and put into practical use.

On the other hand, in conventional electrophotographic type image forming apparatuses, and above all, particularly multi-color image forming apparatuses for effecting color image forming, utilization is widely made of a two-component developing process of mixing a nonmagnetic toner and a magnetic carrier together and using the mixture as a developer. The two-component developing process, as compared with presently proposed other developing processes, has such merits as the stability of the quality of image and the durability of the apparatus, while on the other hand, the deterioration of the developer, particularly the deterioration of the carrier, due to long-period use has been unavoidable and therefore, the work of interchanging the developer along with the long-period use of the multi-color image forming apparatus has become necessary, and this has led to an increase in a service cost and a running cost.

When this two-component developer is applied to a rotary developing apparatus, there have heretofore been proposed several methods of solving such a problem. There is, for example, a method of loading an interchangeable developer supply cartridge into the rotary type developing body of a developing apparatus to thereby effect the supply of a developer including a toner and a carrier and the collection of the developer (for example, Japanese Patent Application Laid-Open No. 6-308829).

Also, in the rotary developing process, there has been put into practical use a developer discharging process utilizing a change in the acting direction of gravity resulting from the rotational movement of the rotary type developing body to supply the two-component developer to the developing apparatus and discharge the two-component developer from the developing apparatus.

For example, in Japanese Patent Application Laid-Open No. 9-218575, as shown in FIG. 10 of the accompanying drawings, there is disclosed a rotary type developing apparatus 101 having four developing apparatuses 200 uniformly provided in a rotary type developing body 101' along the circumferential direction thereof. Each of the four developing apparatuses 200 is provided with a developer cartridge 6 containing therein a developer to be supplied. At a developing position P1 opposed to a drum-shaped photosensitive member (photosensitive drum) 113 as an image bearing member, a developer including a toner corresponding to an amount of toner consumed by a developing operation is supplied to the developing apparatus 200, and any excess developer in the developing apparatus 200 is designed to be discharged into the developer cartridge 6 by the utilization of a change in the acting direction of gravity by the rotation of the rotary type developing body 101'. That is, the rotational movement peculiar to the rotary type developing body 101' is utilized to effect the supply and collection of the developer and therefore, structure is simple, and any reduction in the charging capability of the carrier is prevented without causing the bulkiness of the multi-color image forming apparatus and a rise in the cost thereof.

On the other hand, in Japanese Patent Application Laid-Open No. 10-142888, as shown in FIG. 11 of the accompanying drawings, four developing apparatuses 200 are likewise provided in a rotary type developing body 101', and design is made such that at a developing position P1 whereat a developing apparatus 200 is opposed to a photosensitive drum 113, a developer discharged from the developing apparatus 200 is temporarily stored in a storing portion 70 protrudedly provided on an end portion of the developing apparatus 200, and a change in the acting direction of gravity by the rotation of the rotary type developing body 101' is utilized to carry the developer to a cylinder shaft D0 at the center of the rotary type developing body 101', and the developer is finally collected in a developer collecting container (not shown) provided on an end of the cylinder shaft D0 by a developer transporting member D1 in the cylinder shaft D0. That is, as in the above-described multi-color image forming apparatus, the movement peculiar to the rotary type developing body 101' is utilized to effect the discharge of the developer and therefore, any reduction in the charging capability of the carrier is prevented without causing the bulkiness of the multi-color image forming apparatus and in addition, design is made such that even when single-color image forming is continued, any excess developer in the developing apparatus at the developing position is discharged to the storing portion outside the developing apparatus 200 without the developing operation being stopped and therefore, the amount of developer in the developing apparatus 200 is maintained within an allowable value without image productivity being reduced.

As described above, in these developing apparatuses wherein the excess developers are discharged, there is adopted a construction in which when the level of the developer in a developing container has become high by a predetermined amount, the developer is scooped out by the utilization of the rotational movement of the rotary type developing body, or a construction in which the excess developer is once collected into the storing portion, and then is collected to a location by the utilization of the rotational movement of the rotary type developing body.

In the developing apparatuses of the above-described publications as shown in FIGS. 10 and 11, however, there has been the possibility of the developers in developing devices flowing out by mistake with the rotation of the rotary type developing body.

Or in order to prevent such unnecessary outflow of the developers, a shutter has been provided on an opening for discharging therethrough the excess developers from the developing apparatus, and driving means (such as a motor) for effecting the opening and closing of this shutter has been controlled so as to completely close the opening except when the excess developers are discharged. Such a shutter mechanism has become complicated in construction and has been a cause of the bulkiness and increased costs of the image forming apparatus.

SUMMARY OF THE INVENTION

It is an object of the present invention to provide an image forming apparatus in which a developer can be prevented from being unnecessarily discharged through an opening with the rotation of a rotary member by a simple construction.

It is another object of the present invention to provide an image forming apparatus in which a developer can be prevented from being unnecessarily discharged through an opening with the rotation of a rotary member, and yet any excess developer can be properly discharged through the opening.

It is another object of the present invention to provide an image forming apparatus having:

a developing device containing therein a developer including a toner and a carrier, the developing device having a first chamber for developing an electrostatic image formed on an image bearing member, and a second chamber constituting a developer circulating route between it and the first chamber;

a carrying member rotatably provided in the second chamber for carrying the developer;

a rotary member holding the developing device and rotatable in a route including a developing position;

supplying means for supplying the developer to the developing device at the developing position;

an opening provided in the second chamber for outwardly discharging therethrough any excess developer resulting from the supply of the developer; and a wall portion provided in the second chamber for suppressing the developer flowing out through the opening with the rotation of the rotary member.

Further objects of the present invention will become apparent from the following detailed description when read with reference to the accompanying drawings.

BRIEF DESCRIPTION OF THE DRAWINGS

FIGS. 7A, 7B and 7C are illustrations showing the behavior of the shutter member in a change in the position of the developing apparatus according to the present invention.

DESCRIPTION OF THE PREFERRED EMBODIMENTS

A developing apparatus and an image forming apparatus according to the present invention will hereinafter be described in greater detail with reference to the drawings.

Figure 1:
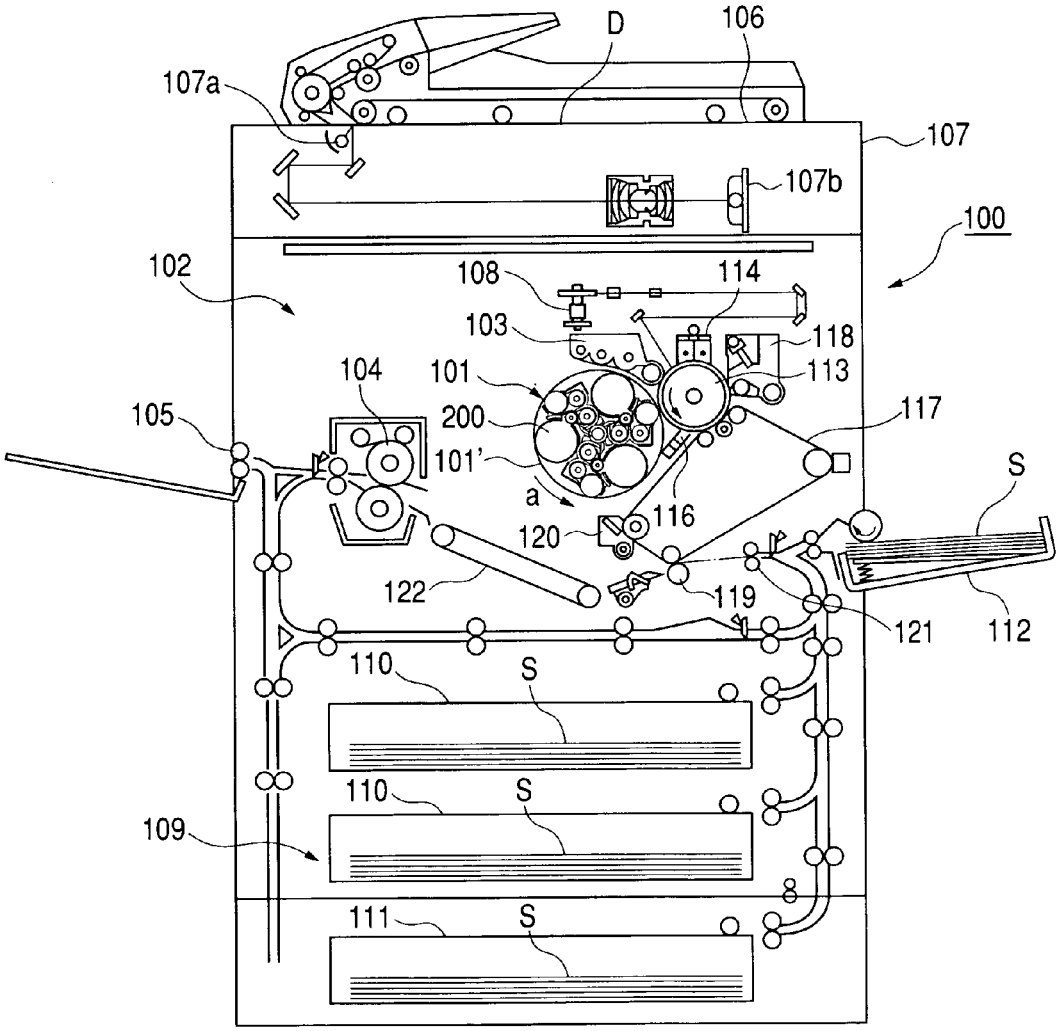
FIG. 1 schematically shows the construction of an embodiment of an image forming apparatus according to the present invention.

FIG. 1 shows an embodiment of a multi-color image forming apparatus (color copying machine) provided with a rotary type developing body according to the present invention.

An apparatus main body 100 shown in FIG. 1 is a multi-color image forming apparatus having a rotary developing apparatus 101 (rotary member) which is a rotary type developing apparatus most characteristic in the present invention.

The apparatus main body 100 is provided with an original supporting stand 106, a light source unit 107, a laser scanner unit 108, a sheet feeding portion 109, an image forming portion 102, etc.

The sheet feeding portion 109 has cassettes 110, 111 and a manually feeding cassette 112 containing transferring materials S therein and detachably mountable in the apparatus main body 100, and the transferring materials S are supplied from these cassettes 110, 111 and the manually feeding cassette 112.

The image forming portion 102 has the function of forming a developer image (toner image) on the surface of a photosensitive drum 113 as an image bearing member, and transferring it to the transferring material S, and has disposed therein a singly-constructed black developing apparatus 103, a cylindrical photosensitive drum 113, a primary charging device 114, a rotary developing apparatus 101 containing therein color developing apparatuses 200Y, 200M and 200C for three colors integral with developer cartridges 6, a post-charging device 116 for adjusting the quality of image after development, an endless ring-shaped transferring belt 117 to which toner images of four colors are transformed in superimposed relationship with one another, whereafter from which the multi-color image is transferred to the transferring material S, a drum cleaner 118 for removing any residual toners on the photosensitive drum 113, a secondary transferring roller 119 for transferring the toner images from the transferring belt 117 to the transferring material, a belt cleaner 120 for removing any residual toners on the transferring belt 117, etc.

Figure 2:
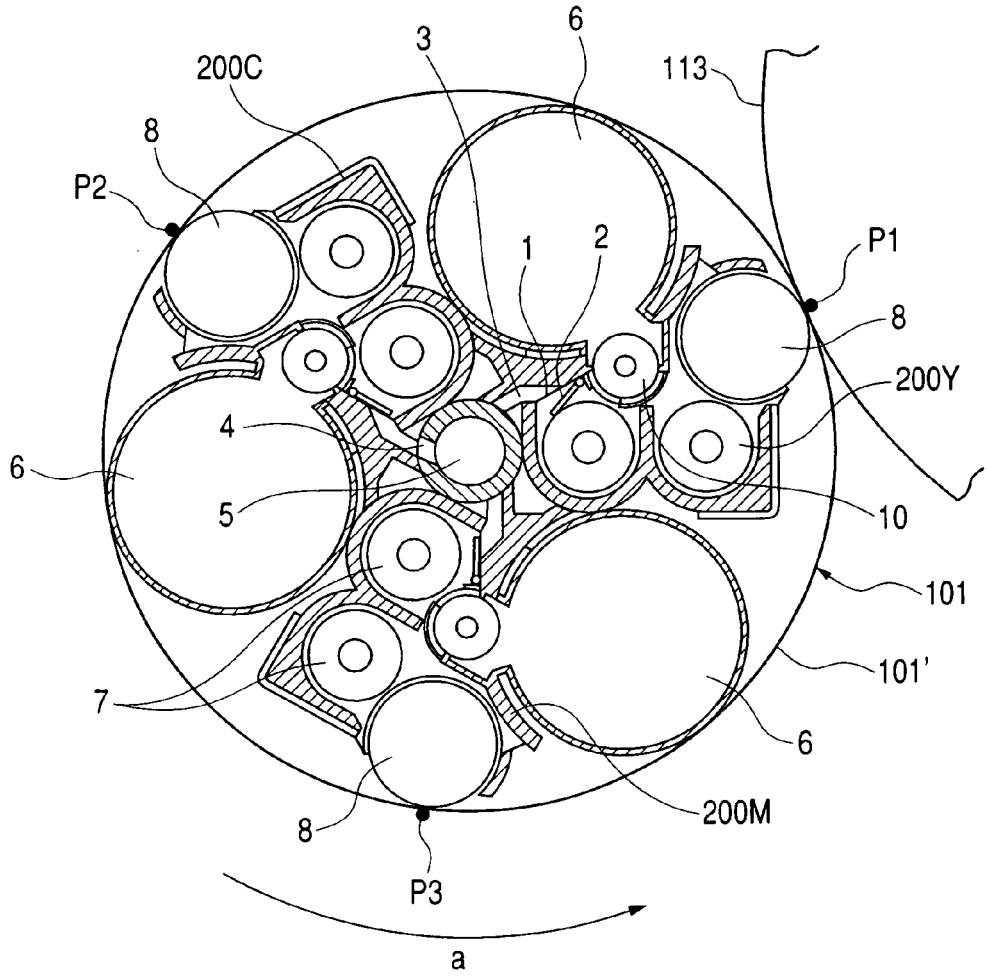
FIG. 2 is a cross-sectional view showing an example of a rotary member (rotary type developing apparatus carrying therein) developing apparatus according to the present invention.

As shown in FIG. 1, in the image forming portion 102, there are disposed the developing apparatus 103 for black and the rotary developing apparatus 101, and the rotary developing apparatus 101, as shown in FIG. 2, is of a construction having developing apparatuses 200 for three-colors, i.e., a developing apparatus 200Y for yellow, a developing apparatus 200M for magenta and a developing apparatus 200C for cyan, in a rotary type developing body 101'. The three developing apparatuses 200Y, 200M and 200C are similar in construction to one another except for the colors of developers.

As what communicates the image forming portion 102 and the sheet feeding portion 109 with each other, there are installed registration rollers 121 for enhancing the accuracy of the posture and position of the transferring material S, and feeding out the transferring material S in timed relationship with the toner images transferred onto the transferring belt 117, and downstream of the image forming portion 102 with respect to the transport direction of the transferring material S, there are disposed a transferring material transporting apparatus 122 for transporting the transferring material S to which the toner images have been transferred, a fixing apparatus 104 for fixing the unfixed image on the transferring material S, discharge rollers 105 for discharging the transferring material S having had the image thereon fixed to the outside of the multi-color image forming apparatus, etc.

The operation of this multi-color image forming apparatus will now be described.

When a sheet feeding signal is outputted from a controller (not shown) provided on the apparatus main body 100 side, a transferring material S is supplied from the cassette 110 or 111 or the manually feeding cassette 112. On the other hand, in the upper portion of the image forming apparatus 100, the light source unit 107 has a light source 107*a* and a CCD unit 107*b* including a CCD, and light applied to and reflected from an original D placed on the original supporting stand 106 is once read by the CCD unit 107*b*, and thereafter is converted into an electrical signal and is replaced by a laser beam in the laser scanner unit 108, and is applied onto the photosensitive drum 113.

The photosensitive drum 113 is charged in advance by the primary charging device 114, and light is applied thereto, whereby an electrostatic latent image is formed thereon, and then a black toner image is formed by the black developing apparatus 103.

The toner image formed on the photosensitive drum 113 has its potential adjusted by the post-charging device 116, and is soon transferred onto the transferring belt 117 at a transferring position. When an image to be formed is of a color mode, the transferring belt 117 is caused to make one more rotation so that the next toner image may be formed and transferred. In the meantime, the rotary type developing body 101' of the rotary developing apparatus 101 rotates a developing apparatus 200 for a designated color in the direction indicated by the arrow "a" so as to be opposed to the photosensitive drum 113, in order to start preparations for forming the first toner image, and makes preparations for developing the next electrostatic latent image. Thus in a full-color mode, the forming, developing and transferring of electrostatic latent images are repeated until a predetermined number of toner images ate completely transferred.

Reference is now had to FIG. 2 to describe the construction of the rotary developing apparatus 101 having the color developing apparatuses 200 carried in the rotary type developing body 101' in the present invention.

As previously described, the rotary member (rotary type developing body) 101' has the three developing apparatuses 200 similar in construction, i.e., the developing apparatus 200Y for yellow, the developing apparatus 200M for magenta and the developing apparatus 200C for cyan, and the rotary type developing body 101' is freely rotatable by a motor (not shown).

The rotary type developing body 101', as its initial state, is stopped at a rotated position 60° short of a developing position P1 at which the photosensitive drum 113 and the developing apparatus 200Y for yellow are proximate to each other. This is for the purpose of causing a developing sleeve 8 provided in the developing apparatus 200 for each color to stop and stand by at a phase position farthest from the photosensitive drum 113 so that the photosensitive drum 113 may not be adversely affected by the strong magnetic force of the developing sleeve 8 which is a developer carrying member.

When a developing operation is to be performed on the photosensitive drum 113 to thereby form a full-color toner image, after the termination of the developing by the black developing apparatus 103, the developing apparatus 200Y for yellow is rotated by 60° and moved to the developing position P1 at which it becomes proximate to the photosensitive drum 113 to thereby effect developing.

Subsequently, in order to form a toner image of another color, the rotary type developing body 101' is rotated by 120° to thereby dispose the developing apparatus 200M for magenta at the developing position P1, and developing is likewise effected, and the forming of a cyan toner image is also effected in a similar manner. When the developing operation in each color is finished, the rotary type developing body 101' is rotated by 60° to stand by at its home position again, and waits for the start of the next job.

Now, the transferring material S fed from the sheet feeding portion 109 has its skew feeding corrected by the registration rollers 121, and is further timed and transported to the image forming portion 102. Then, the toner images are transferred to the transferring material S by the secondary transferring roller 119, and the separated transferring material S is transported to the fixing apparatus 104 by a transporting apparatus 122, and the unfixed transferred image is permanently fixed on the transferring material S by the heat and pressure of the fixing apparatus 104. The transferring material S having had the image thereon fixed is discharged out of the apparatus main body 100 by the discharge rollers 105.

In this manner, the transferring material S fed from the sheet feeding portion 109 in the image forming apparatus 100 has an image formed thereon and is discharged.

When black-and-white image forming is to be effected, a toner image formed on the photosensitive drum 113 by the black developing apparatus 103 containing a black toner therein is primary-transferred onto the transferring belt 117, and thereafter is immediately secondary-transferred onto a recording sheet S, and the recording sheet S stripped off from the transferring belt 117 is transported to the fixing apparatus 104 by the transporting apparatus 122, and is pressurized and heated by the fixing apparatus 104 to thereby provide a permanent image. The single-color image forming by this process is about four times higher in image productivity than full-color image forming.

Reference is now had to FIGS. 3, 4, 5A and 5B to describe in detail the structure of the color developing apparatuses 200Y, 200M and 200C provided in the rotary developing apparatus 101 which is a rotary type developing apparatus, and a discharging mechanism for excess developers when two-component developers are used in them, with the developing apparatus 200Y for yellow taken as an example.

The developing apparatus 200M for magenta and the developing apparatus 200C for cyan are also similar in construction and function to the developing apparatus 200Y for yellow.

Figure 3:
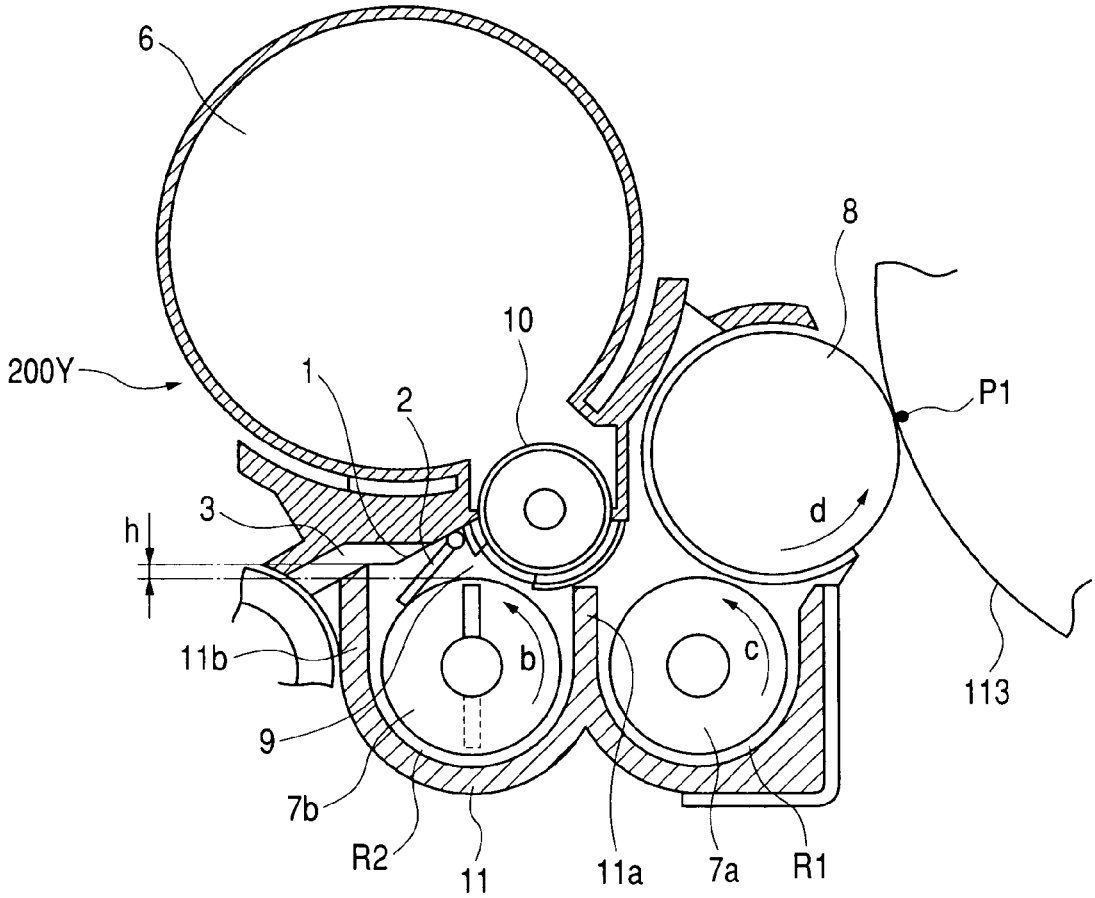
FIG. 3 is a front cross-sectional view showing an example of the developing apparatus according to the present invention.
Figure 4:
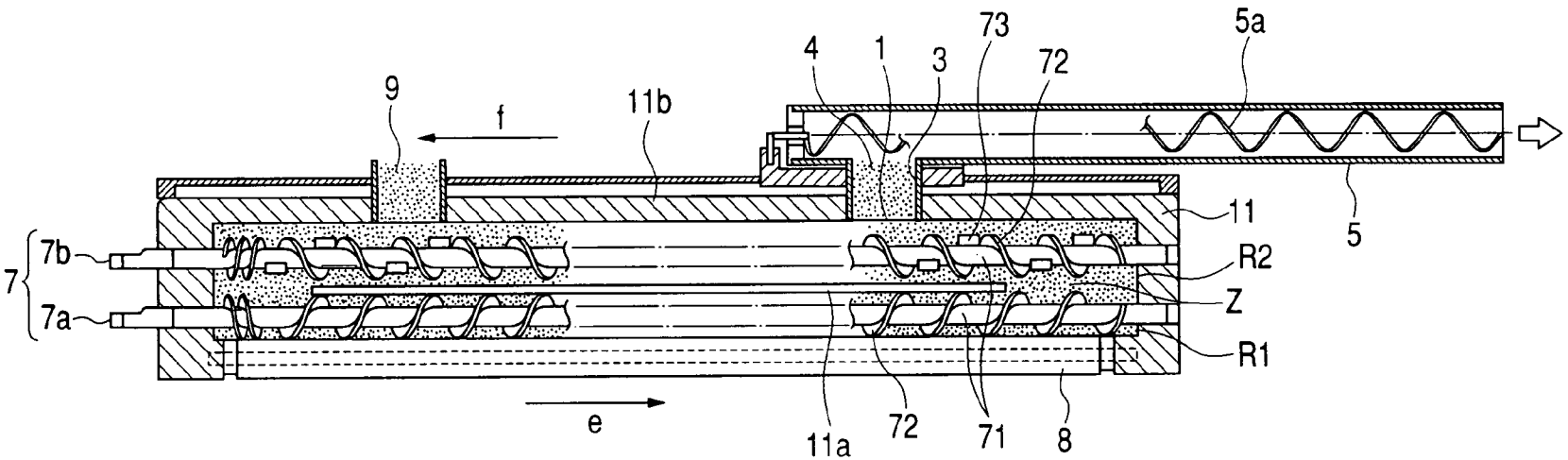
FIG. 4 is a top cross-sectional view showing an example of the developing apparatus according to the present invention.
Figure 5B:
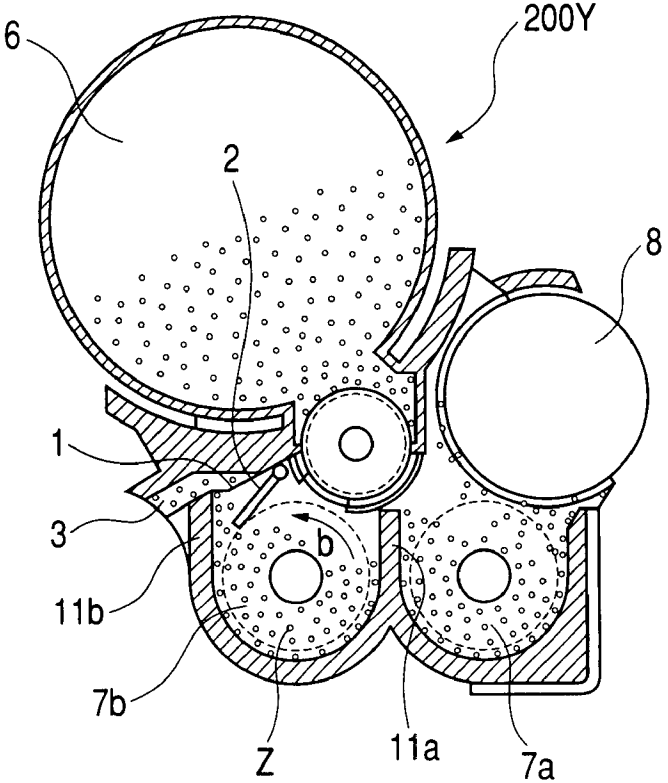
FIGS. 5A and 5B are illustrations showing the behavior of a developer in the developing apparatus according to the present invention.
Figure 5A:
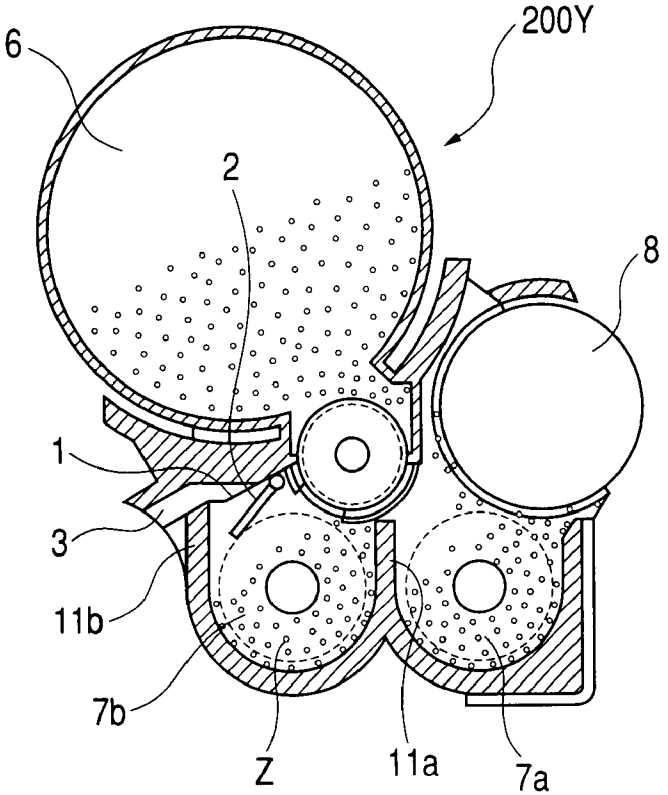

FIG. 3 is a front cross-sectional view of the developing apparatus 200Y, FIG. 4 is a top cross-sectional view showing the construction of the essential portions of the developing apparatus 200Y, and FIGS. 5A and 5B illustrate the non-driven state and the driven state, respectively, of the developing apparatus 200Y.

As shown in FIGS. 3 and 4, the developing apparatus 200Y is such that the interior of a developing container 11 containing a developer therein is divided into two portions, i.e., a first agitating chamber R1 (first chamber) and a second agitating chamber R2 (second chamber) provided in parallelism to the photosensitive drums 113, and in a state wherein the developing apparatus 200Y is located at the developing position P1 whereat it is ready to perform the developing operation, the one near to the photosensitive drum 113 is defined as the first agitating chamber R1 and the one far from the photosensitive drum 113 is defined as the second agitating chamber R2. The first agitating chamber R1 and the second agitating chamber R2 are juxtaposed in a horizontal direction at the developing position.

The developing device 200Y opens at a developing area opposed to the photosensitive drum 113, and the developing sleeve 8 is rotatably disposed in such a manner as to be partly exposed in this opening portion. The developing sleeve 8 is formed of a nonmagnetic material, and includes therein a stationary magnet (magnet roll) which is magnetic field producing means, and during the developing operation, it is rotated in the direction indicated by the arrow "d" in FIG. 3 and holds the two-component developer in the developing apparatus 200Y in the form of a layer and carries it to the developing area, and supplies the two-component developer to the developing area opposed to the photosensitive drum 113 to thereby develop the electrostatic latent image on the photosensitive drum 113. The two-component developer after having developed the electrostatic latent image is carried in accordance with the rotation of the developing sleeve 8 and is collected into the developing apparatus 200Y.

The developing sleeve 8 is provided on the first agitating chamber R1 side. Also, the first agitating chamber R1 (the developing sleeve side) and the second agitating chamber R2 (the supply and discharge side) are partitioned by a partition plate 11*a*, and a developing screw 7 which is an agitating chamber is disposed in each of the first agitating chamber R1 and the second agitating chamber R2. The developer is agitated and maintains a uniform state while being circulated in the first agitating chamber R1 and the second agitating chamber R2 by the screws 7. It is to be understood here that description will hereinafter be made with the developing screw as a carrying member on the first agitating chamber R1 side defined as 7*a* and with the developing screw as a carrying member on the second agitating chamber R2 side defined as 7*b*.

The developing screws 7, as shown in FIG. 4, have rotary shafts 71 parallel with the developing sleeve 8, and spiral augers 72 which are spiral vane members are provided on the rotary shafts 71. The developing screws 7*a* and 7*b* are provided with the spiral augers 72 in opposite directions, and are rotated in the same directions (arrows "b" and "c" in FIG. 3) to thereby carry the developer in opposite directions.

The two-component developer in the developing container 11 is carried in the direction indicated by the arrow "e" in FIG. 4 by the first developing screw 7*a* (the first agitating chamber R1 side) and in the direction indicated by the arrow "f" in FIG. 4 (a direction opposite to the direction indicated by the arrow "e") by the second developing screw 7*b* (the second agitating chamber R2 side), whereby it is circulated in the developing container 11 and is agitated.

On the second developing screw 7*b* on the second agitating chamber R2 side, in order to more enhance the agitating action, besides the spiral auger 72 for chiefly carrying the developer Z in the developing container 11, an agitation promoting plate 73 which is a plate-shaped agitation promoting member is disposed so that the developer Z may be sufficiently agitated.

Now, in the developing container 11, there is contained the two-component developer including a nonmagnetic toner and a magnetic carrier, and the density of the toner in the developer in its initial state is of the order of 8% by weight percentage. This value is one which should be properly adjusted by the charging amount of the toner, the particle diameter of the carrier, the construction of the multi-color image forming apparatus, etc., and which need not always follow this numerical value.

The two-component developer containing the toner and carrier corresponding to an amount consumed by image forming is supplied from the developer supply port 9 of a developer cartridge 6 into the developing apparatus 200Y by the rotational force of a supplying screw 10 and gravity. The mixing ratio of the toner and carrier in this supplied developer is of the order of 9:1 by weight ratio, but is not particularly restricted to this numerical value.

That is, the amount of toner is overwhelmingly great relative to the ratio of the two-component developer in the developing container 11, and taking the volume ratio thereof into consideration, it can also be considered that a slight amount of carrier is mixed in the toner. That is, when making up for the toner consumed by image forming, a slight amount of carrier is gradually supplied. If the rate of the carrier in the supplied developer becomes great, the replacing amount of carrier becomes great by the same amount of toner supply and the two-component developer in the developing apparatus 200Y approximates to a fresh state, but the consumed amount of carrier becomes correspondingly greater, and this leads to an increase in a running cost. Therefore, it is preferable to discretely determine a suitable mixing ratio in each developing apparatus.

Also, the supplied amount of the developer is approximately determined by the number of revolutions of a supplying screw 10 provided in the developer supply port 9 portion of the developer cartridge 6, and this number of revolutions is determined by toner supply amount control means (not shown).

When the developing apparatus 200Y is at the developing position P1, that is, when the carrier is supplied to the developing apparatus 200Y and particularly, a high-density image is to be formed, a great amount of carrier of the order of several tens of milligrams is supplied and therefore, the amount of developer in the developing apparatus 200Y is increased and the level of the developer becomes high.

When the level of the developer becomes higher than the second developer circulating screw 7*b*, the second developer circulating screw 7*b* cannot sufficiently agitate the developer and therefore, the toner immediately after supplied is carried to the first developer circulating screw 7*a* while remaining insufficiently charged, and is used for the developing operation. Therefore, toner fog is caused to the white ground portion of an image, and when the amount of developer is further increased, the developer overflows the developing container 11 and the interior of the multi-color image forming apparatus 200 is contaminated.

As can be seen also from FIG. 2, in the developing apparatus 200Y, an excess two-component developer discharge port 1 is disposed in the second agitating chamber R2, and a shutter member 2 for controlling the discharge position of the excess two-component developer is disposed near the discharge port 1, and a collection port 3 for collecting the excess two-component developer is provided in the rotary type developing body 101'.

As shown in FIG. 3, the developer discharge port 1 is disposed at a height of a predetermined distance h from the upper end of the second developer circulating screw 7*b*, and at the developing position P1, the developer discharge port 1 is rendered open by the shutter member 2. The predetermined distance h is a height determined by the number of revolutions of the developing screw 7*b*, the pitch of the spiral auger 72 and the shape of the agitating promoting plate 73. In this case, this distance is set to 1.5 mm to thereby obtain a good stable discharge characteristic.

Also, the developer discharge port 1 is provided at a location higher than the center of rotation of the second developer circulating screw 7*b* and in a developing container wall surface 11*b* downstream of a partition wall 11*a* with respect to the direction of rotation of the screw 7*b*.

With such a construction, if the level of the developer becomes higher than the second developer circulating screw 7*b*, the excess developer overflows and is discharged through the developer discharge port 1 without the rotary type developing body being rotated, and the level of the developer is maintained at the height of the second developer circulating screw 7*b*. Therefore, the above-mentioned toner fog to the white ground portion of the image and the overflow of the developer from the developing apparatus 200Y will never happen.

As shown in FIG. 4 which is a top plan view of the essential portion of the developing container 11 as it is seen from above it, in the second circulating chamber R2, the developer discharge port 1 is disposed near the second developer circulating screw 7*b* and upstream of the developer supply port 9 with respect to the direction of circulation f of the developer. Therefore, the circulation of the developer near the developing sleeve 8 is not disturbed, and it never happens that the developer immediately after supplied is discharged.

Also, as can be seen from FIGS. 2, 3 and 4, in the discharge port 1, there is provided a collection path 3 which is a discharge passageway for communicating the discharge port 1 and a developer collection pipe 5 with each other, and once storing therein and then discharging the excess two-component developer discharged from the developing apparatus 200Y, and the excess two-component developer collected from the collection path 3 is carried from the developer collection pipe 5 to the outside of the rotary developing apparatus 101.

A carrying member 5*a* is rotatably disposed in the developer collection pipe 5 so that the collected developer can be carried to the outside of the rotary type developing body 101' by drive transmitting means (not shown).

While in FIG. 2, a position for collecting the excess two-component developer into the developer collection pipe 5 is defined as P2 moved from the developing position P1 and rotated by 120° from the developing position P1, the position P2 for collecting the excess developer into the developer collection pipe 5 is not particularly restricted. Even if the excess developer is once stored in the collection port 3, and then is collected to the developer collection pipe 5 side at other position, it differs in no way from the gist of the present invention.

That is, the developing apparatus 200Y is provided with the developer supply port 9 at one end of the upper wall of the developing container 11 near the second developer circulating screw 7*b*, and the developer discharge port 1 having the shutter member 2 at the other end of the upper wall, and communicates with the developer collection port 3, the other end of which communicates with the developer collection pipe 5. Also, the developer discharge port 1 is disposed at the height of the predetermined distance h from the upper portion of the second developer circulating screw 7*b*, and opens upwardly and therefore, it never happens that with an increase in the amount of two-component developer in the developing container 11, the level of the developer becomes higher than the second developer circulating screw 7*b*.

As shown in these figures, it can be mentioned as characteristic points that the construction of a discharging mechanism is designed as follows.

(I) A first point is that the discharging position of the developing apparatus 200Y relative to the photosensitive drum 113 as a position for the rotary type developing body 101' to move the developing apparatus 200Y in order that the developing apparatus 200Y may discharge the excess developer is defined as the same position P1 as the developing position. That is, when the discharge of the excess developer is to be done, the rotary type developing body 101' moves the developing apparatus 200Y to the developing position P1.

During the discharge of the excess developer, the agitating and carrying members 7 in the developing apparatus 200Y agitate and carry the two-component developer in the developing apparatus 200Y while being rotated, thereby circulating the developer in the developing apparatus 200Y.

That is, by the rotary type developing body 101' being rotated, the developing apparatus 200Y has various developer level positions therein, but if the developing screw 7 are rotated with the position of the developing apparatus 200Y brought to the developing position P1, the level height of the developer becomes stable and discharge becomes easy to control.

(II) A second point is that the discharges port 1 is disposed on the second agitating chamber R2 side and is set on the upper side of the developing screw 7*b* and the container wall surface 11*b* on the downstream side with respect to the direction of rotation of the rotary shaft 71, shown in FIG. 3, at the developing position P1.

The upper side of the developing screw 7*b* refers to a location higher than the center of rotation of the developing screw 7*b*, and the container wall surface on the downstream side with respect to the direction of rotation of the rotary shaft 71 refers to the wall surface 11*b* on the downstream side with respect to the direction of rotation of the rotary shaft 71 of the developing screw 7*b*, among the wall surface, the wall surface 11*b* and the partition plate 11*a* of the developing container 11 provided on the axial side of the developing screw 7*b*.

The reason why the discharge port 1 is disposed on the second agitating chamber R2 side is that if the discharge port 1 is disposed on the first agitating chamber R1 side, discharge can be hardly effected under the influence of the magnetic force from the magnet roll disposed in the developing sleeve 8, or the carrier which should originally be discharged is absorbed and only the toner which should not be discharged will be discharged.

Further, even if the discharge port 1 could be disposed on the first agitating chamber R1 side in sufficiently spaced apart relationship with the magnet roll, only the level of the developer in and near an area in the axial direction of the developing sleeve 8 in which the discharge port 1 exists will lower and therefore, the supply of the developer to the developing sleeve 8 will become small in the area wherein the discharge port 1 exists, and only that portion of a formed image which corresponds thereto will become low in density.

Consequently, the reason why the discharge port 1 is disposed on the second agitating chamber R2 side and is set on the upper side of the developing screw 7*b* and on the container wall surface 11*b* on the downstream side with respect to the direction of rotation (the direction indicated by the arrow "b" in FIG. 3) is that when as previously described, the developing screw 7*b* is rotated in the direction indicated by the arrow "b" in FIG. 3 to discharge the excess developer at the developing position P1, the developer Z in the developing container 11 is pushed toward the upper side of the developing screw 7*b* and the container wall surface 11*b* on the downstream side with respect to the direction of rotation (the direction indicated by the arrow "b" in FIG. 3) and the level of the developer near the wall surface rises and therefore, stable discharge can be aimed at.

(III) A third point is that as shown in FIG. 4, the location of the discharge port in the axial direction is in an area wherein the partition plate 11*a* between the first agitating chamber R1 and the second agitating chamber R2 exists. That is, the discharge port 1 is not provided at a location opposed to the communicating portion between the first agitating chamber R1 and the second agitating chamber R2.

This is because if the discharge port 1 is provided in an area wherein the partition plate 11*a* does not exist, i.e., the communicating portion between the first agitating chamber R1 and the second agitating chamber R2, the level of the developer is liable to become low or discharge is hampered under the influence of the magnet roll in the developing sleeve 8 in the first agitating chamber.

While in the present invention, a developing apparatus having two agitating chambers is described as an example, the number of agitating chambers is not limited to two from the gist of the present invention, but of course, the gist of the present invention will change in no way if the developing apparatus is provided with a plurality of developer agitating chambers.

It is preferable that the developer discharge port 1 be provided in other one of the plurality of agitating chambers than the agitating chamber R1 nearest to the location at which the developing sleeve 8 is provided.

As the most characteristic point in the present invention, the operating situation of the excess developer discharging mechanism when the developing screws 7 are rotated will now be described in detail with reference to FIGS. 5A and 5B.

Design is made such that rotative drive is first inputted from a developing drive input source, not shown, to the sleeve gear (not shown) of the developing sleeve 8. This developing drive is designed such that the number of revolutions is adjusted in the developing apparatus 200Y and the drive is transmitted to the developing screws 7.

FIG. 5A is a front view of essential portions illustrating the state immediately after the developing apparatus 200Y has entered the developing position P1, and FIG. 5B is a front view of the essential portions illustrating a state in which rotative drive has been inputted to the developing apparatus 200Y and the developing sleeve 8 and the developing screws 7 have been rotated.

First, the rotary type developing body 101' is set so as to be rotated in the direction indicated by the arrow "a" in FIG. 2, that is, so that the developing sleeve 8 may get up from a downwardly facing state to a horizontally facing state, and therefore, as shown in FIG. 5A, the level of the developer Z contained in the interior of the developing apparatus 200Y which has just entered the developing position P1 is higher on the developing sleeve 8 side.

When the rotative driving timing of the developing sleeve 8 soon comes, a controller (not shown) instructs the developing drive input to rotate, and rotative drive is transmitted to the developing sleeve gear (not shown). Thereupon, as previously described, the number of revolutions is adjusted in the developing apparatus 200Y and the developing screws 7*a* and 7*b* receive the transmission of the drive and begin to be rotated.

The then developer Z, as shown in FIG. 5B, is carried in the direction indicated by the arrow "b" in FIG. 5B contained in the interior of the developing apparatus 200Y, and is carried to the vicinity of the developing apparatus wall surface 11*b*.

As previously described, besides the spiral auger 72, the plate-shaped agitation promoting plate 73 is provided on the developing screw 7*b* in the second agitating chamber R2 and therefore, the second developing screw 7*b* is high in the agitating and carrying property, as compared with the first developing screw 7*a*. Therefore, the developer Z rotatively carried by the second developing sleeve 7*b* becomes high in pressure near the wall surface 11*b* and becomes high in its level near the wall surface 11*b* because the space in which it can be carried by the developing screw 7*b* is narrowed by the developing container wall surface 11*b*.

In the present invention, it is the most characteristic point that the stable discharge of the excess developer is realized by the utilization of the movement of the level of the developer resulting from the rotation of this developing screw 7*b*.

By doing so, the level height of the developer is markedly stabilized and an amount of discharge as aimed at can be successfully obtained as compared with a case where the construction of the discharge port is determined on the basis of the level height of the developer by the revolution in the afore-described example of the conventional art, and a case where the construction of the discharge port is determined on the basis of only the level height of the developer after the rotation of the developing screw.

Also, in the process of setting conditions for it, the number of revolutions of the developing screw greatly affecting the image characteristic cannot be greatly changed as in the conventional construction and therefore, as compared with a case where only the height and cross-sectional area of the discharge port are relied on for the setting of the conditions, the height and area of the agitation promoting plate can be freely changed as the adjustment parameters of the amount of discharge and therefore, the setting of the conditions becomes markedly easy to do and any complicated construction is not required and thus, it becomes possible to provide a low-cost and stable excess developer discharging mechanism.

While regarding the direction of rotation of the rotary type developing body, a counter-clockwise direction as viewed from the front of the image forming apparatus has been shown as an example thereof, even in the case of clockwise rotation, the inclination of the developer Z when the developing apparatus has entered the developing position P1 only becomes opposite and remains unstable and therefore, of course, from the gist of the present invention, the direction of rotation of the rotary type developing body is not restricted to one direction.

As described above, not only in the case of the rotation in which the rotation stop position of the developing apparatus 200Y is at each angle of 120°, but also in a case where the stop position includes, besides the developing position P1, other various stop positions such as a non-uniform developer cartridge interchanging position, design is made such that the excess developer is discharged from the developing apparatus 200Y only when it is stable in posture at the developing position P1, and is not discharged from the developing apparatus 200Y when it is at any other phase position and therefore, this is wide in its copying range and realizes a very stable discharge characteristic, which in turn contributes to the stability of a high quality of image.

While in the construction of the rotary developing apparatus 101, a three-color rotary construction has been shown as an example, the number of the developing apparatuses 200 carried on the rotary type developing body 101' is not restricted thereto from the gist of the present invention, but of course, an effect can be sufficiently obtained even if there is adopted a four-color rotary developing apparatus construction wherein the black developing apparatus is disposed in the rotary developing apparatus 101 so that the developing apparatus may be rotated by each angle of 90°.

Also, even in a case where the rotation stop time of the rotary type developing body is shortened or the rotary type developing body exhibits, besides the developing stop position which visits periodically stably during a continuous image forming operation, unstable stop position behavior such as a home position standby position which visits after the termination of a job, or a developer cartridge interchange stop standby position in which the developing body is stopped and stands by only when the toner in the cartridge has become small in amount, or even in a case where the rotary type developing body has a plurality of stop positions as in a construction wherein the developing body is stopped and stands by at a home position whereat the developing sleeve is not opposed to the photosensitive member, or a construction wherein the developing body is stopped and stands by at a developer cartridge interchanging position, the excess amount of developer aimed at can be discharged reliably, and it has become possible for the discharging mechanism to stably maintain a high quality of image.

Also, the excess developer discharging mechanism does not require any complicated constituent members, and this leads to an inexpensive and stable construction, and also to the elimination of the necessity of the work of interchanging the developers, and thus, an improvement in maintenance property and a reduction in running cost can be realized.

Figure 6:
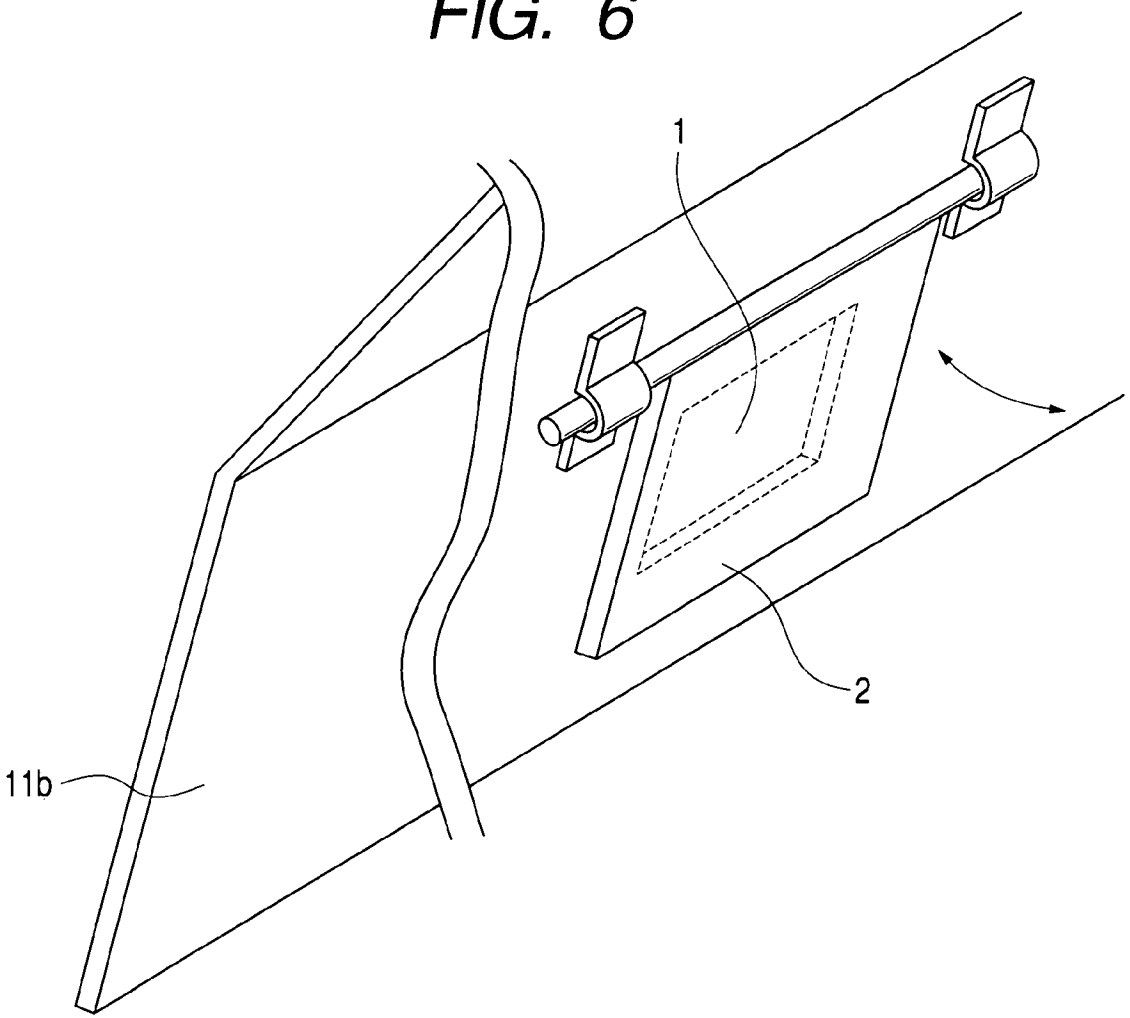
FIG. 6 is a perspective view showing a developer discharge port and an example of a shutter member according to the present invention.

In the above-described developing apparatus 200Y, the operating situation of the shutter member 2 during an ordinary continuous image forming operation will now be described with reference to FIGS. 6, 7A, 7B and 7C. FIG. 6 is a perspective view of essential portions illustrating the mounted state of the shutter member 2 provided in the discharge port 1 of the developing apparatus 200Y, and FIGS. 7A to 7C are front views of essential portions illustrating the operation of the shutter member 2.

First, as shown in FIG. 6, in the developing apparatus 200Y, the shutter member 2 is pivotally mounted in the excess developer discharge port 1, and the opening and closing angle thereof is prescribed by an opening-closing amount adjusting mechanism (not shown) Thus, the shutter member 2, at the developing position P1, is controlled into an opened state by gravity, at the other positions is controlled into a closed state by gravity.

Next, a state in which in FIG. 2, the developing apparatus 200Y for yellow exists at the developing position P1 is shown in FIG. 7A. Here, the positional relationship between the developer discharge port 1 and the level of the developer in the developing apparatus is such that the developer discharge port 1 is located above the level of the developer in the developing apparatus and therefore, the shutter member 2 is in its opened state by gravity. Thereby, as described above, the two-component developer including the toner corresponding to an amount consumed by image forming is supplied form the developer cartridge 6, and the amount of developer in the developing container 11 is increased and the level of the developer becomes higher than the second developer circulating screw 7*b*, whereupon the excess developer overflows and is discharged through the developer discharge port 1, and is collected into the collection port 3 and therefore, the level of the developer is maintained at the height of the second developer circulating screw 7*b*.

When the developing operation of the developing apparatus 200Y is terminated, the rotary type developing body 101' is rotated by an angle of about 120° in preparation for the developing operation by the developing apparatus 200M for the next color, and the developing apparatus 200Y is moved to a position 2 in FIG. 2. The then state is shown in FIG. 7B. At this time, the developing sleeve 8 assumes an upwardly facing posture along the periphery of the rotary type developing body 101', and the discharge port 1 comes to underlie the shutter member 2 and therefore, as shown in FIG. 7B, the shutter member 2 is rotatively moved by gravity and the developer discharge port 1 becomes closed and thus, it never happens that the developer in the developing apparatus 200Y leaks to the collection port 3 through the developer discharge port 1. The excess two-component developer delivered from the collection port 3 to the developer collection pipe 5 is sequentially carried and discharged to the outside of the rotary type developing body 101' by a carrying member 5*a* disposed in the developer collection pipe 5.

When the developing operation of the developing apparatus 200M is terminated, the rotary type developing body 101' is again rotated by about 120° in preparation for the developing operation by the developing apparatus 200C for the next color, and the developing apparatus 200Y is moved to a position P3 in FIG. 2. The then state is shown in FIG. 7C. At this time, the developing sleeve 8 assumes a downwardly facing posture along the periphery of the rotary type developing body, and the discharge port comes to underlie the shutter member 2 and therefore, as shown in FIG. 7C, the shutter member 2 still keeps the developer discharge port 1 closed by the pressure of the two-component developer in the developing container 11 and thus, again it never happens that the developer in the developing apparatus 200Y leaks out to the collection port 3 through the developer discharge port 1. Even if the developer leaks out, it never happens that the developer flows to the developer collection pipe 5 side due to the action in the direction of gravity.

As described above, the shutter member 2 becomes opened only at the developing position P1 and it never happens that the excess developer in the developing apparatus 200Y is unexpectively discharged outwardly and therefore, even when in order to discharge the developer, a plurality of non-uniform rotating operations including the developing position P1 of the rotary type developing body 101' are performed, the amount of developer in the developing apparatus 200Y can be stably maintained within an allowable range and therefore, the property of maintaining a high quality of image is not lowered.

In the present invention, by the leakage preventing operation of the shutter member 2 hitherto described, the construction of the storing and discharge passageway 4 between the developer collection port 3 and the developer collection pipe 5 can be made very simple, and this greatly contributes to a reduction in the cost of the rotary type developing body 101', and further of the multi-color image forming apparatus 200.

Figure 8:
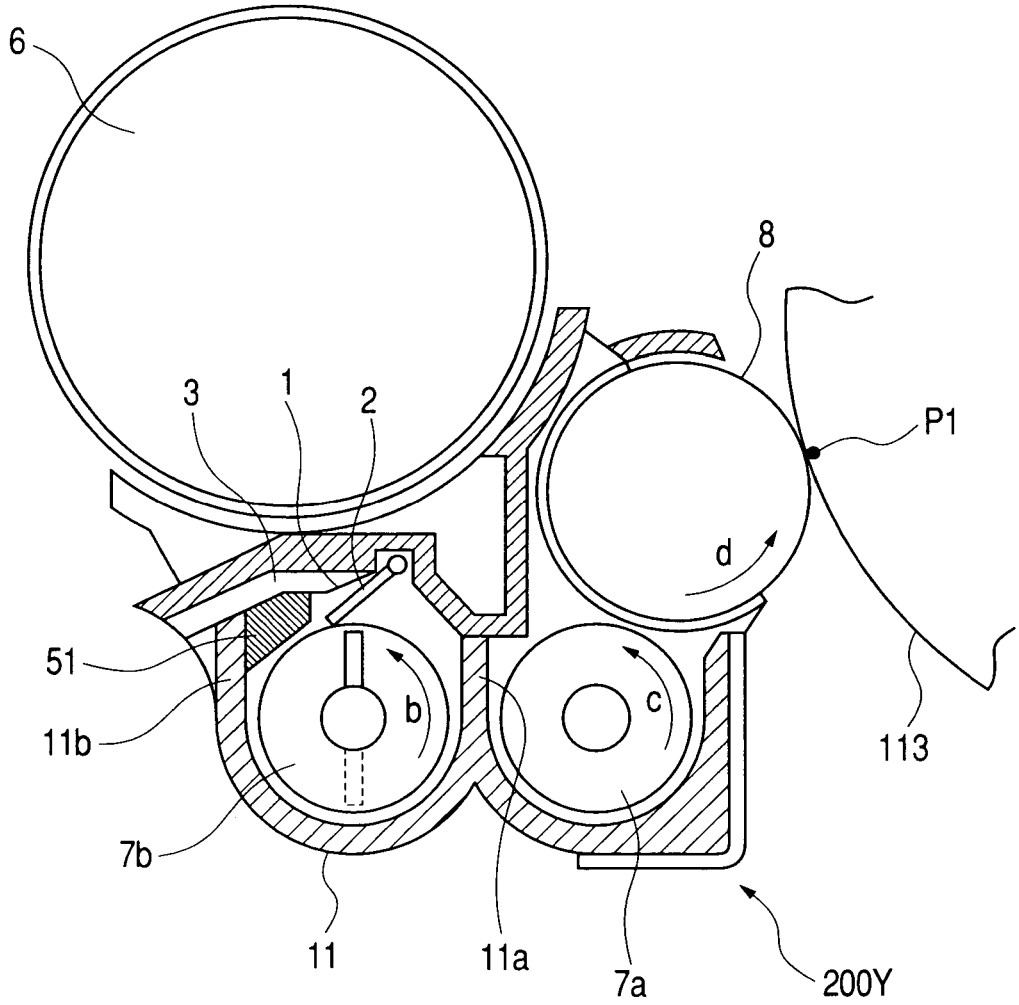
FIG. 8 is a cross-sectional view showing the developing apparatus according to the present invention.
Figure 9B:
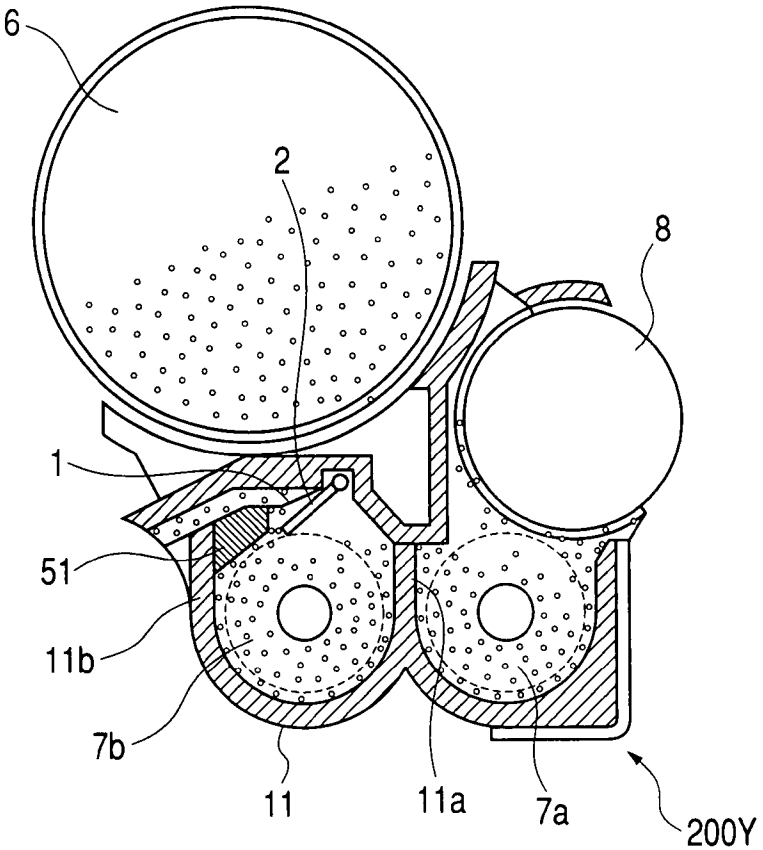
FIGS. 9A and 9B are illustrations showing the behavior of the developer in the developing apparatus according to the present invention.
Figure 9A:
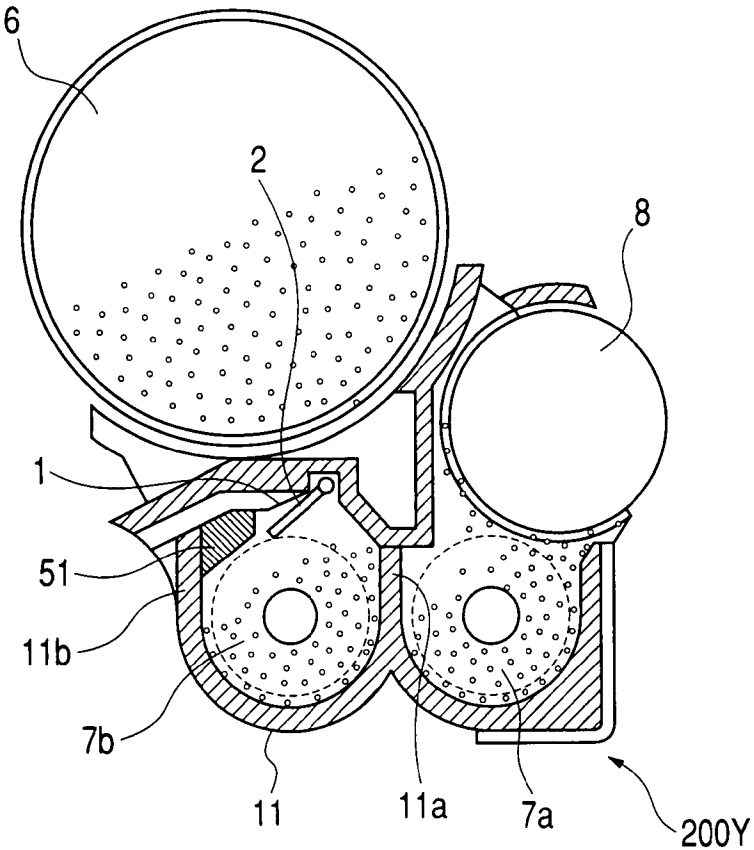
Figure 10:
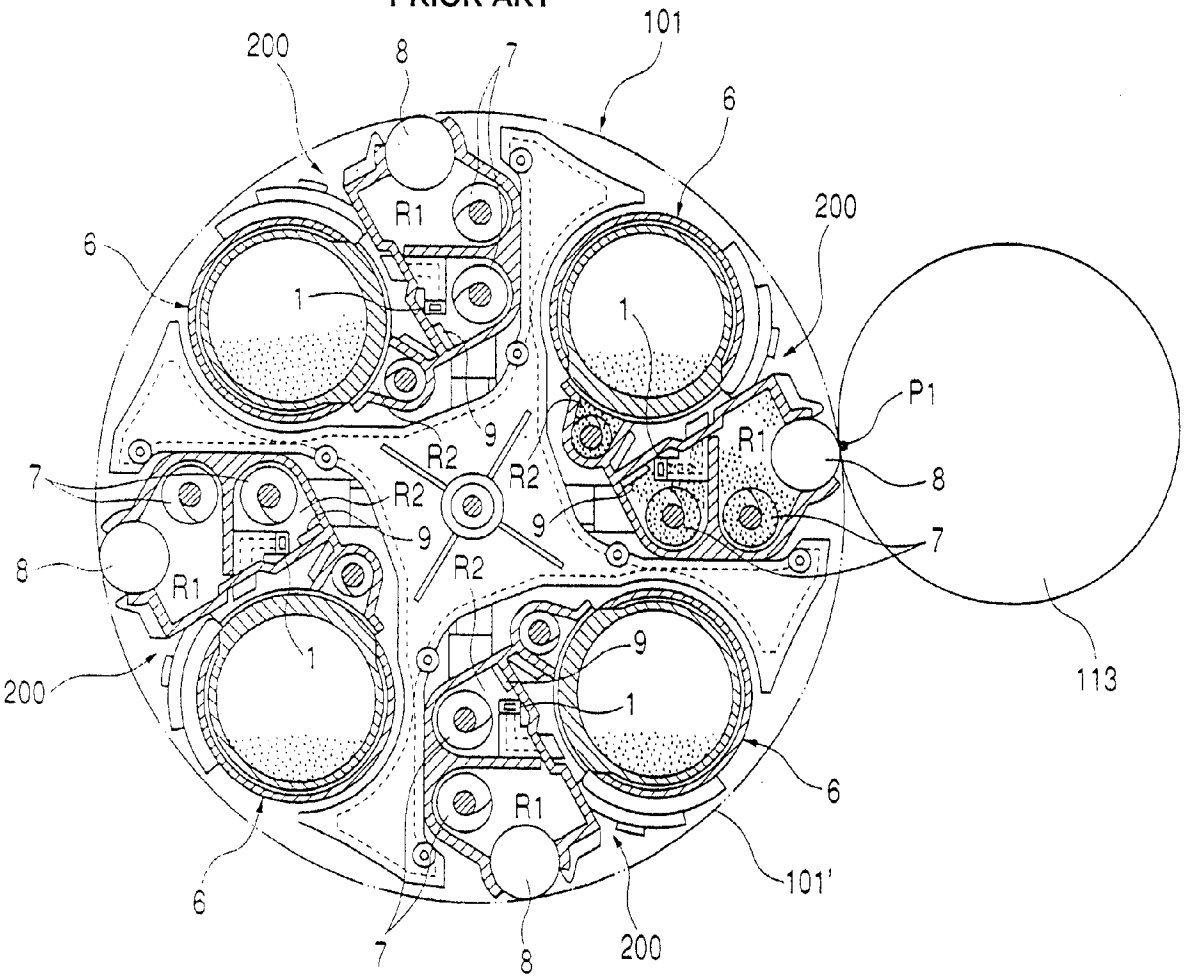
FIG. 10 PRIOR ART
FIG. 10 is a cross-sectional view showing an example of the conventional developing apparatus and rotary member.
Figure 11:
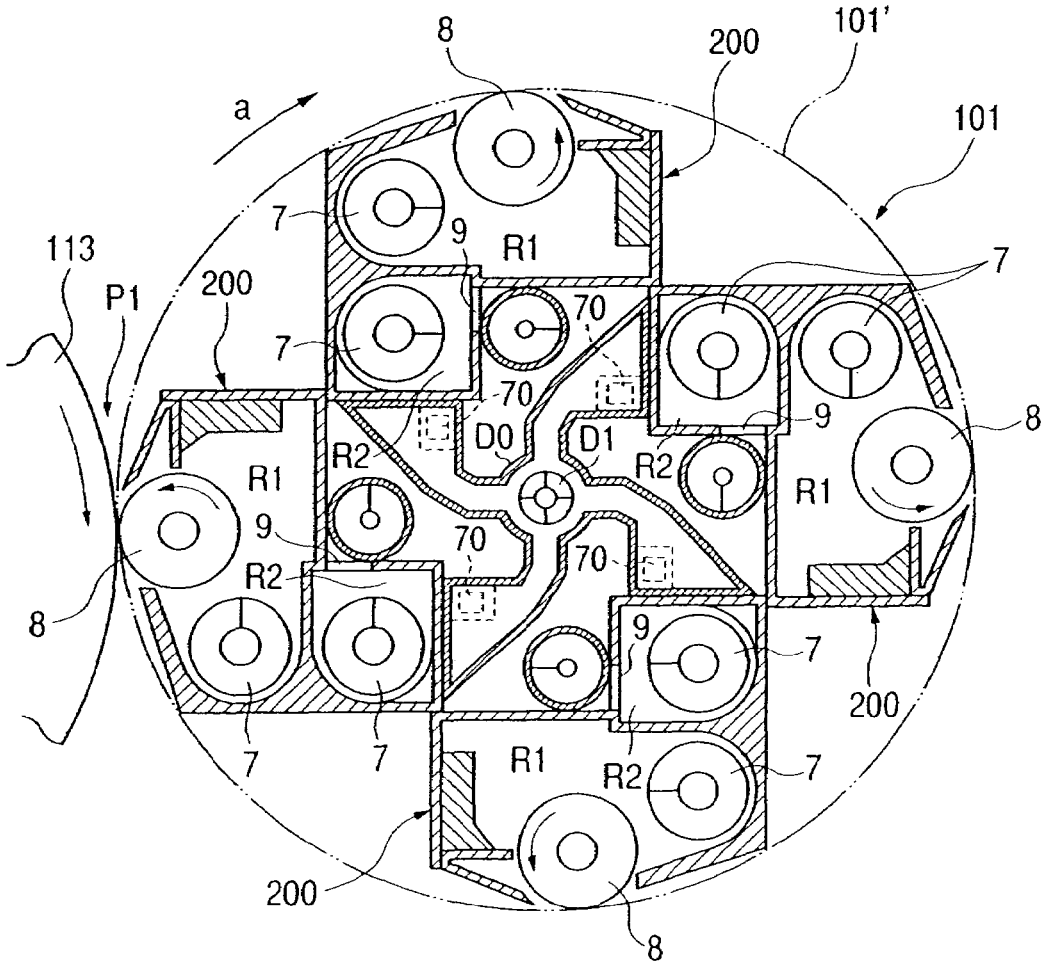
FIG. 11 PRIOR ART
FIG. 11 is a cross-sectional view showing an example of the conventional developing apparatus and rotary member.

FIG. 8 is a front view of essential portions illustrating the developing apparatus 200Y (located at the developing position P1) representing the characteristic portion of the present invention, and FIGS. 9A and 9B illustrate the non-driven state and driven state, respectively, of the developing apparatus 200Y.

That is, it is the most characteristic point that in the developing container 11, on the upper side and downstream side of the second developing screw 7*b* with respect to the direction of rotation of the rotary shaft, i.e., near the developer discharge port 1, there is provided a dam portion 51 (wall portion) for damming up some of the developer rotatively agitated by the developer screw 7*b*.

The set position of the dam portion 51, as shown in FIG. 8, is the lower portion of the excess developer discharge port 1.

By the dam portion being provided at this position, the developer can be prevented from unnecessarily flowing out of the developing container through the discharge port with the rotation of the rotary type developing body. As will be described later, the outflow of the developer resulting from the rotation of the rotary type developing body can be prevented, and yet the excess developer resulting from the supply of the developer can be effectively discharged through the opening.

The direction of rotation of the rotary type developing body 101' is the direction indicated by the arrow "a" indicated in FIG. 2. That is, the level of the developer Z contained in the developing container 11 which has entered the developing position P1, as shown in FIG. 9A, is higher on the developing sleeve 8 side, as described above. The direction of rotation of the rotary type developing body 101', however, is not restricted to one direction from the gist of the present invention, as described above.

Here, design is made such that when developing drive is transmitted from the developing drive input (not shown) to the developing apparatus 200Y side, the number of revolutions is adjusted in the developing container 11 and the drive is transmitted to the developing screws 7*a* and 7*b* and therefore, the developing screws 7 begin to be rotated.

The second developing screw 7*b* in the second agitating chamber R2 has, besides the spiral auger 72, the plate-shaped agitation promoting 73 provided on the rotary shaft 71 and thus, as shown in FIG. 9B, with the direction of rotation b of the developing screw 7*b* which has started its rotation, the developer Z is carried more strongly to the container wall surface 11*b* side opposed to the developing sleeve 8 of the developing apparatus.

The dam portion 51 dams up some of the developer Z thus carried, whereby the developer containing space in the developing container is further narrowed by the dam portion, whereby in this portion, the pressure for pushing up the level of the developer is heightened and the level of the developer on the upper portion of the dam portion 51 becomes high. The discharge port 1 is provided in the upper portion of this dam portion 51 (when the developing device is at the developing position) and therefore, as described above, with the rotation of the developing screw 7*b*, the high raised developer overflows through the discharge port 1.

In the discharge port 1, there is provided the above-described shutter member 2 (a valve mechanism opened and closed by gravity with the rotation of the rotary type developing body) so that unexpected discharge may not take place except at the developing position P1.

As described above, the adjustment of the level of the developer Z is effected not by the wall surface 11*b* of the developing container 11, but by the use of the dam portion 51, whereby the range within which the location of the discharge port 1 can be set is increased and the degree of freedom of designing is increased and therefore, it also becomes possible to demand stable discharge at a lower cost. In the present embodiment, the dam portion is provided at a distance of 6 mm from the wall surface of the developing apparatus 200Y and therefore, the discharge port 1 can be set substantially centrally of the second agitating chamber R2 and the discharging mechanism can be contained on the developing container 11 side, and it is made possible to greatly downsize the rotary type developing body 101'. In such a sense as well, the construction proposed in the present embodiment contributes to the lower cost, the higher speed and the higher quality of image of the multi-color image forming apparatus.

What is claimed is:

1. An image forming apparatus comprising:

an image bearing member on which an electrostatic image is formed;

a developing device, which develops the electrostatic image in a developing position, which is opposite to said image bearing member, said developing device including a developing container having a first chamber and a second chamber constituting a developer circulating route, a developer carrying member provided in said first chamber for carrying the developer to develop the electrostatic image, and an agitating and carrying member provided in said second chamber and having a spiral vane provided around a rotary shaft to agitate and carrying the developer;

a rotary member holding said developing device and rotatable in a route including said developing position;

supplying means for supplying the developer to said developing device, which is in said developing position;

an opening, provided in a wall of said second chamber located above an upper end of said spiral vane of said agitating and carrying member and located downstream in a rotation direction of said agitating and carrying member in a region above a rotation center of said agitating and carrying member in said second chamber in a state in which said developing device is in said developing position, for discharging excess developer resulting from the supply of the developer by said supplying means through said opening to an outside of said developing device; and an opening and closing member provided so that one end of said opening and closing member is pivotally moved about a pivot center provided at the other end of said opening and closing member, said opening and closing member being pivotally moved to a position for opening said opening when said developing device is in the developing position, the one end of said opening and closing member being located downstream of the pivot center in the rotation direction of said agitating and carrying member.

2. An image forming apparatus according to claim 1, further comprising an agitation promotion portion, provided on said rotary shaft of said agitating and carrying member in a vicinity of said opening, for agitating the developer.

3. An image forming apparatus according to claim 1, further comprising a wall portion provided in a vicinity of said opening in said second chamber, said wall portion protruding toward an inside of said second chamber.

4. An image forming apparatus according to claim 2, wherein said agitating and carrying member is in the form of a plate.

5. An image forming apparatus according to claim 4, further comprising a plurality of agitating and carrying members provided on said rotary shaft.

6. An image forming apparatus according to claim 3, wherein said wall portion is located near the one end than the pivot center.

* * * * *

UNITED STATES PATENT AND TRADEMARK OFFICE

CERTIFICATE OF CORRECTION

PATENT NO. : 7,233,756 B2
APPLICATION NO. : 10/693981
DATED : June 19, 2007
INVENTOR(S) : Masashige Tamura It is certified that error appears in the above-identified patent and that said Letters Patent is hereby corrected as shown below:

ON THE TITLE PAGE:
Item (73), Assignee, "CANON KABUSHIKI KAISKA" should read --CANON KABUSHIKI KAISHA--.

Item (56), References Cited, Foreign Patent Documents, "JP 06019300 1/1994" should read --JP 6-19300 1/1994--, "JP 2000066500 3/2000" should read --JP 20002258611 9/2002--, "JP 2000-66500 3/2000" should read --JP 2002-258611 9/2002--.

COLUMN 1:
Line 17, "developer images toner images" should read --developer image (toner image)--.

COLUMN 5:
Line 53, "ate" should read --are--.

COLUMN 13:
Line 58, "(not shown)" should read --(not shown).--.
Line 60, "gravity" should read --gravity, and--.

COLUMN 14:
Line 55, "unexpectively" should read --unexpectedly--.

COLUMN 15:
Line 15, "high" should read --high- --.

UNITED STATES PATENT AND TRADEMARK OFFICE

CERTIFICATE OF CORRECTION

PATENT NO. : 7,233,756 B2
APPLICATION NO. : 10/693981
DATED : June 19, 2007
INVENTOR(S) : Masashige Tamura It is certified that error appears in the above-identified patent and that said Letters Patent is hereby corrected as shown below:

COLUMN 16:
Line 33, "carrying" should read --carry--.

Signed and Sealed this

Twentieth Day of November, 2007

JON W. DUDAS
*Director of the United States Patent and Trademark Office*